US008850660B2

(12) United States Patent
Kim

(10) Patent No.: US 8,850,660 B2
(45) Date of Patent: Oct. 7, 2014

(54) HINGE DEVICE

(75) Inventor: Joon Seob Kim, Cheonan-si (KR)

(73) Assignee: Nifco Korea Inc., Cheonan-Si (KR)

( * ) Notice: Subject to any disclaimer, the term of this patent is extended or adjusted under 35 U.S.C. 154(b) by 0 days.

(21) Appl. No.: 13/697,192

(22) PCT Filed: May 11, 2011

(86) PCT No.: PCT/KR2011/003457

§ 371 (c)(1),
(2), (4) Date: Jan. 7, 2013

(87) PCT Pub. No.: WO2011/142578

PCT Pub. Date: Nov. 17, 2011

(65) Prior Publication Data

US 2013/0205540 A1 Aug. 15, 2013

(30) Foreign Application Priority Data

May 12, 2010 (KR) ..... 20-2010-0005001 U

(51) Int. Cl.

| | |
|---|---|
| ***E05F 1/08*** | (2006.01) |
| ***E05F 1/10*** | (2006.01) |
| ***E05F 3/20*** | (2006.01) |
| ***G03G 15/00*** | (2006.01) |

(52) U.S. Cl.

CPC ..... *E05F 3/20* (2013.01); *E05Y 2900/608* (2013.01); *E05F 1/1058* (2013.01); *G03G 15/00* (2013.01); *E05Y 2201/638* (2013.01)

USPC ..... 16/296; 16/286; 16/289

(58) Field of Classification Search

USPC ..... 16/277, 325, 335, 284, 342, 242, 239, 16/286, 322, 352, 280–282, 361, 366, 371, 16/257, 258, DIG. 34; 358/497–498; 399/377, 379, 380, 38; 355/25, 75, 77; 361/679.06, 679.12, 679.27, 679.28

See application file for complete search history.

(56) References Cited

U.S. PATENT DOCUMENTS

| | | | | |
|---|---|---|---|---|
| 4,660,251 | A * | 4/1987 | Watabe | 16/367 |
| 4,853,750 | A * | 8/1989 | Murata et al. | 355/75 |
| 4,884,317 | A * | 12/1989 | Liu | 16/289 |
| 6,158,085 | A * | 12/2000 | Oshiro | 16/72 |
| 6,453,804 | B1 | 9/2002 | Lee | |
| 6,593,999 | B1 | 7/2003 | Hosaka | |
| 6,766,563 | B2 * | 7/2004 | Lee | 16/286 |
| 7,069,622 | B2 * | 7/2006 | Ohara et al. | 16/286 |

(Continued)

FOREIGN PATENT DOCUMENTS

| | | | |
|---|---|---|---|
| JP | 2001-159797 | A | 6/2001 |
| JP | 2002014496 | A * | 1/2002 |

(Continued)

OTHER PUBLICATIONS

PCT, "International Search Report for PCT/KR2011/003457", Jan. 11, 2012.

*Primary Examiner* — Chuck Mah

(74) *Attorney, Agent, or Firm* — Manabu Kanesaka

(57) ABSTRACT

A hinge device in which a slider elastically supported by a compressive coil spring is put into contact with a pivotal lever installed on a cover of a product which swings open or closed. The hinge device can increase a free stop section and simultaneously prevent the cover from being incidentally open.

5 Claims, 3 Drawing Sheets

(56) References Cited

U.S. PATENT DOCUMENTS

| | | | | |
|---|---|---|---|---|
| 7,240,401 | B2 * | 7/2007 | Tamehira et al. | 16/284 |
| 7,665,183 | B2 * | 2/2010 | Choi | 16/286 |
| 7,949,292 | B2 * | 5/2011 | Choi | 399/380 |
| 2006/0179611 | A1 * | 8/2006 | Ohara et al. | 16/286 |
| 2007/0089271 | A1 * | 4/2007 | Jo et al. | 16/286 |
| 2007/0199178 | A1 * | 8/2007 | Katsumata | 16/286 |

FOREIGN PATENT DOCUMENTS

| | | | | |
|---|---|---|---|---|
| JP | 2003129739 | A | * | 5/2003 |
| JP | 2008-264248 | A | | 11/2008 |
| KR | 2002-0066267 | A | | 8/2002 |

* cited by examiner

HINGE DEVICE

RELATED APPLICATIONS

The present application is National Phase of International Application No. PCT/KR2011/003457 filed May 11, 2011, and claims priority from Korean Application No. KR 20-2010-0005001, filed May 12, 2010.

BACKGROUND OF THE INVENTION

1. Field of the Invention

The present invention relates to a hinge device and, more particularly, to a hinge device in which a slider elastically supported by a compressive coil spring contacts with a pivotal lever installed on a cover swinging open or closed so as to be able to increase a free stop section and simultaneously to prevent the cover from being incidentally open.

2. Description of the Related Art

Such hinge devices are devices that support a cover, which is installed on an upper portion of the main body of a product and swings to open or close, such as a cover of a duplicator, a cover of a scanner, or a cover of a multifunctional peripheral.

In the case of a conventional hinge device in which a free stop function of allowing an opening or closing angle of a cover to be freely set within a predetermined range is made, the hinge devices have a problem that causes loud noises or does an injury to a user when closed, because the free stop section is short.

Further, in the case of a hinge device in which a damping function of allowing a cover to be closed slowly is made, the hinge device has a problem in that it is impossible to maintain an open state up to a desired section (angle).

Meanwhile, when the cover of the duplicator or the scanner is incidentally open, a copied or scanned state becomes bad. As such, it is important for the cover to be stably put into close contact with the main body without being incidentally open. However, in the related art, since the cover is prevented from being incidentally open using a separate locking device, this costs a lot, and makes operation complicated.

SUMMARY OF THE INVENTION

Accordingly, the present invention has been made in an effort to solve the problems occurring in the related art, and an object of the present invention is to provide a hinge device, which increases a free stop section of a cover, thereby being capable of reducing noises and preventing an injury when the cover is closed, and improving perceived quality.

Another object of the present invention is to provide a hinge device capable of preventing a cover from being incidentally open for itself and thus saving a cost.

In order to achieve the above objects, there is provided a hinge device, which includes: a housing that is fixedly installed on a main body of a product and has a pair of hinge holes formed in an upper portion thereof; a pivotal lever that is installed on a cover of the product and has a hinge connector installed on a rear lower portion thereof, the hinge connector being inserted into and coupled to an upper end of the housing and having a hinge hole; a hinge shaft that is inserted into and coupled to the hinge hole of the housing and the hinge holes of the pivotal lever and supports the pivotal lever and the cover so as to swing; a compressive coil spring that is installed in the housing; and a slider that is installed in an upper portion of the housing, is elastically supported by the compressive coil spring, and is in contact with a lower end face of the hinge connector of the pivotal lever at an upper end thereof.

Further, in the hinge device, the lower end face of the pivotal lever may include a cam surface toward the front in which a distance from the hinge center is gradually increased and then reduced again, and the upper end face of the slider may include a bearing surface toward the front in which a height is increased and then reduced again, so that, when a nose of the cam surface of the pivotal lever passes through a peak of the bearing surface, a direction in which an elastic force of the compressive coil spring is applied is changed, and thus the cover is prevented from being incidentally open.

In the hinge device of the present invention, when the cover is open or closed, a free stop section of the cover can be increased. Thereby, the hinge device can reduce noises and prevent an injury when the cover is closed, and improve perceived quality. In the state in which the cover is closed, the cover is elastically supported by the compressive coil spring. Thereby, the hinge device can stably prevent the cover from being incidentally open without a separate additional device.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Reference will now be made in greater detail to a preferred embodiment of the present invention with reference to the accompanying drawings.

Figure 1:
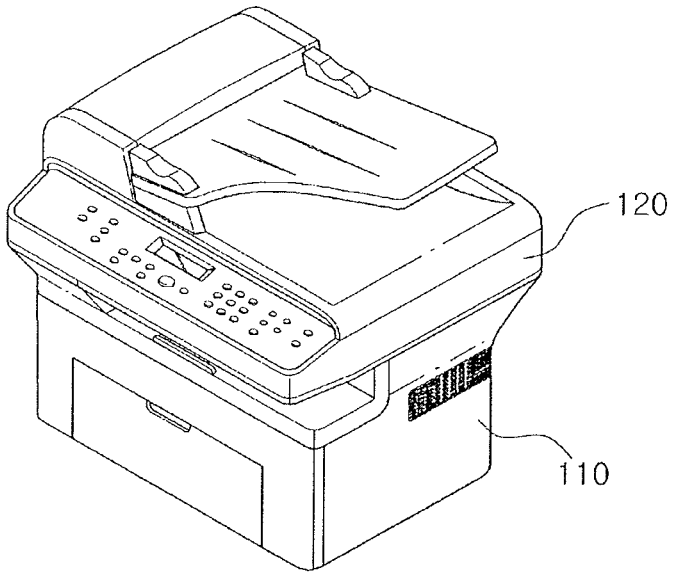
FIG. 1 is a perspective view showing a multifunctional peripheral on which a hinge device relevant to the present invention is mounted.
Figure 2:
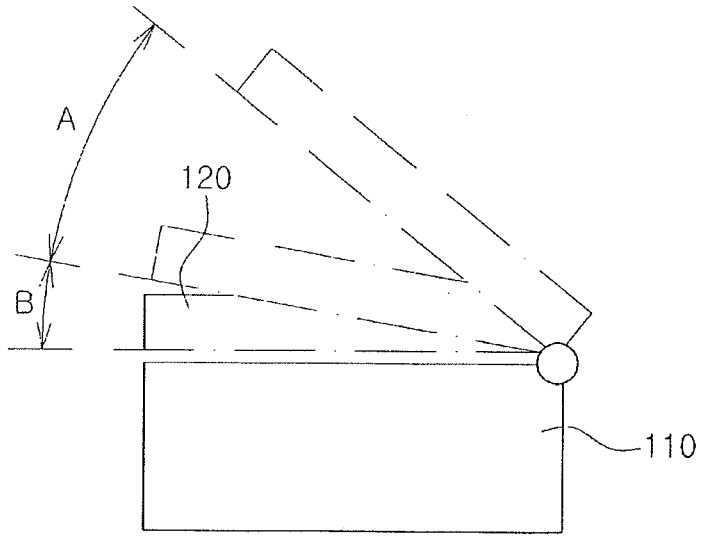
FIG. 2 is a schematic side view showing the multifunctional peripheral of FIG. 1.

FIG. 1 is a perspective view showing a multifunctional peripheral on which a hinge device relevant to the present invention is mounted, and FIG. 2 is a schematic side view showing the multifunctional peripheral of FIG. 1.

Figure 3:
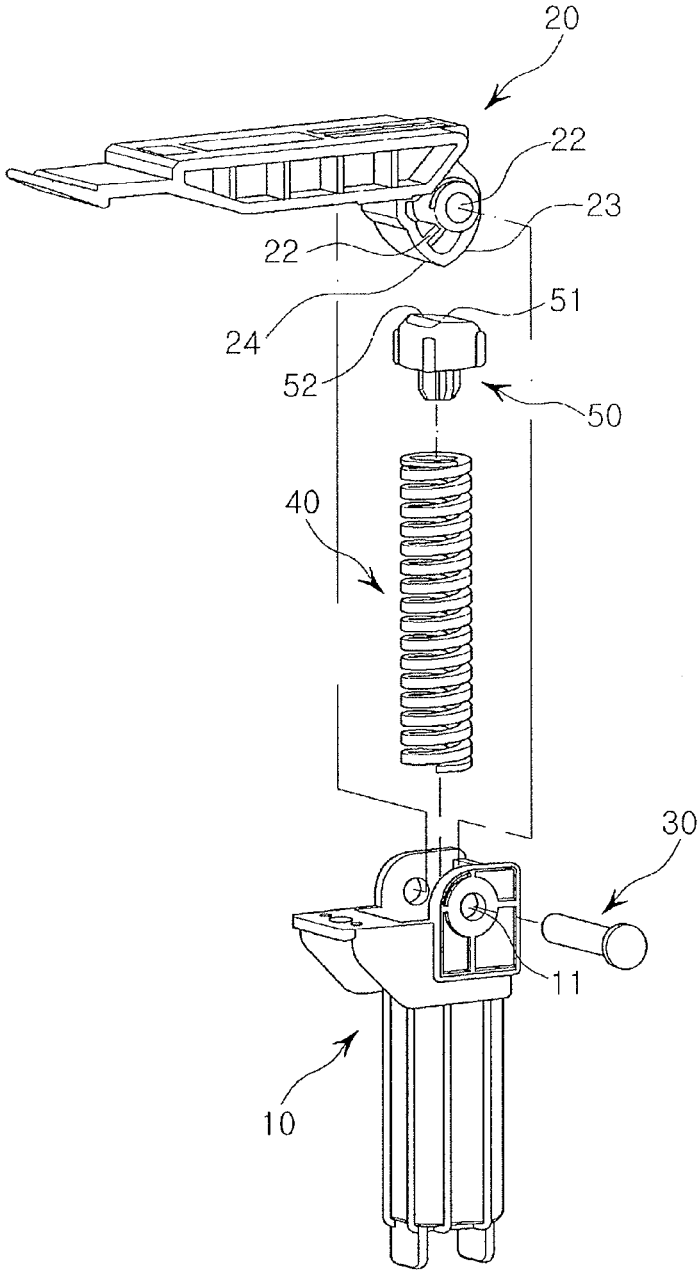
FIG. 3 is an exploded perspective view showing a hinge device according to an embodiment of the present invention.
Figure 4A:
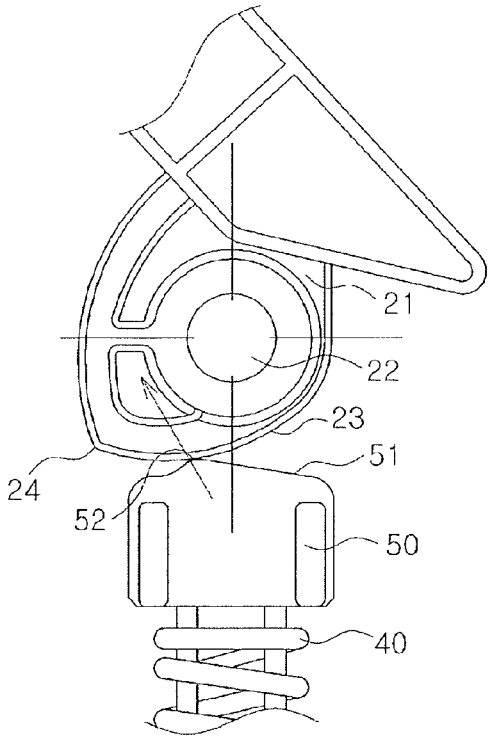
FIG. 4*a* is a side view showing main parts of the hinge device when a cover is opened.
Figure 4B:
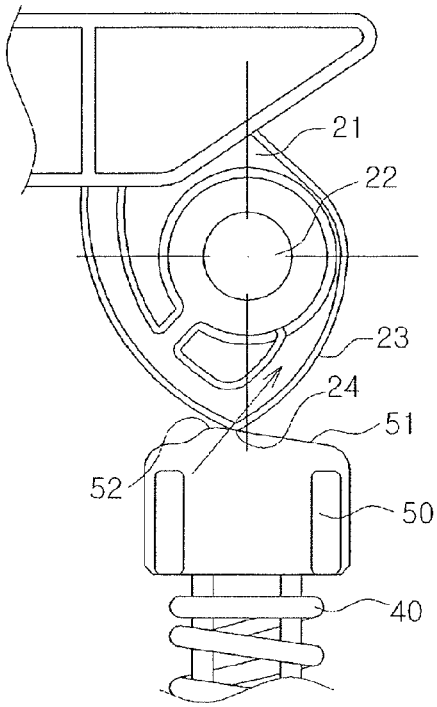
FIG. 4*b* is a side view showing main parts of the hinge device when a cover is closed.

FIG. 3 is an exploded perspective view showing a hinge device according to an embodiment of the present invention. FIG. 4*a* is a side view showing main parts of the hinge device when a cover is opened, and FIG. 4*b* is a side view showing main parts of the hinge device when a cover is closed.

As shown in FIGS. 1 to 4*b*, the hinge device of the present invention includes: a housing 10 that is fixedly installed on a main body 110 of a product and has a pair of hinge holes 11 formed in an upper portion thereof; a pivotal lever 20 that is fixedly installed on a cover 120 and has a hinge connector 21 that is installed on a rear lower portion thereof, the hinge connector 21 being inserted into and coupled to an upper end of the housing 10 and having a hinge hole 22; a hinge shaft 30 that is inserted into and coupled to the hinge hole 11 of the housing 10 and the hinge holes 22 of the pivotal lever 20 and supports the pivotal lever 20 and the cover 120 so as to swing; a compressive coil spring 40 that is installed in the housing 10; and a slider 50 that is installed in an upper portion of the housing 10, is elastically supported by the compressive coil spring 40, and is in contact with a lower end face of the hinge connector 21 of the pivotal lever 20 at an upper end thereof.

In the hinge device of the present invention, the lower end face of the pivotal lever 20 is provided with a cam surface 23 toward the front in which a distance from a hinge center is gradually increased and then reduced again. The upper end face of the slider 50 is provided with a bearing surface 51 toward the front in which a height is increased and then reduced again. Thus, the hinge device is configured so that, when a nose 24 of the cam surface 23 of the pivotal lever 20 passes through a peak 52 of the bearing surface 51, a direction in which an elastic force of the compressive coil spring 40 is applied is changed.

The hinge device of the present invention which is configured as described above is configured to allow the cover 120 connected to the pivotal lever 20 as in FIG. 2 to swing open in an upward direction by a predetermined angle in a horizontal closed state. A section ranging from a maximum opening angle to a predetermined closing angle becomes a free stop section A in which the pivotal lever 20 and the cover 120 can be stopped at an arbitrary angle, and a section other than the free stop section until the cover 120 is in the horizontal closed state becomes a free-falling section B in which the cover 120 swings due to its self-weight.

Meanwhile, in the hinge device of the present invention, the slider 50 installed in the upper portion of the housing 10 transmits the elastic force of the compressive coil spring 40 to the pivotal lever 20 while moving in a vertical direction when the cover 120 is open or closed.

In the hinge device of the present invention, a repulsion force (reaction force) F of the compressive coil spring 40 installed in the housing 10 occurs at a contact point of the pivotal lever 20 and the slider 50, and a direction thereof is a direction perpendicular to the contact point. As such, as in FIG. 4*a*, in the case of the free stop section A in which the nose 24 of the cam surface 23 of the pivotal lever 20 is located in front of the peak 52 of the bearing surface 51, a compression force Fs of the compressive coil spring 40 produces the repulsion force (reaction force) F that swings the pivotal lever 20 in a clockwise direction (opening direction) via the peak 52 of the bearing surface 51, so that the pivotal lever 20 and the cover 120 can be supported at a desired opening angle.

After the nose 24 of the cam surface 23 of the pivotal lever 20 is brought into contact with the peak 52 of the bearing surface 51 by a user swinging the cover 120 and the pivotal lever 20 in a counterclockwise direction (closing direction) in the free stop section A, the free stop section is converted into the free-falling section. Thus, even when the user removes an applied force, the cover 120 and the pivotal lever 20 swing in the counterclockwise direction, and thus the cover 120 is closed.

In the state in which the cover 120 is closed, the nose 24 of the cam surface 23 of the pivotal lever 20 is brought into contact with the rear of the peak 52 of the bearing surface 51 as in FIG. 4*b*. Thereby, the compressive coil spring 40 produces the repulsion force (reaction force) F that swings the pivotal lever 20 in the counterclockwise direction (closing direction). As such, the cover 120 can be reliably put into close contact with the main body 110 of the product without incidental opening.

In this way, in the hinge device of the present invention, the applied direction of the repulsion force (reaction force) F of the compressive coil spring 40 is determined depending on a contact position of the slider 50 and the pivotal lever 50, and is changed into the opposite direction as soon as the nose 24 of the cam surface 23 of the pivotal lever 20 passes through the peak 52 of the bearing surface 51 while the cover 120 is being closed. Thus, the cover 120 is elastically supported toward the main body 110 of the product, so that the cover 120 can be prevented from being incidentally open.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A hinge device comprising:

a housing adapted to be fixed to a main body of a product;

a pivotal lever adapted to be fixed to a cover of the product and having a hinge connector attached to a rear lower portion thereof, the hinge connector being coupled to an upper end of the housing and rotatable about a center axis;

a compressive coil spring installed in the housing; and a slider installed in an upper portion of the housing and elastically supported by the compressive coil spring to contact with a lower end face of the hinge connector of the pivotal lever at an upper end of the slider, wherein the pivotal lever includes a cam having a cam center defined by said center axis, and an outer periphery forming an outer cam surface having a nose in a middle thereof having a longest distance from the center axis of the cam center such that a distance from the center axis to the cam surface gradually decreases from the nose at two sides relative to the nose, the slider includes a bearing surface having front and rear portions and a peak between the front and rear portions, the bearing surface has a height gradually increasing in the rear portion to the peak and reducing from the peak in the front portion with an inclination greater than that in the rear portion so that when the cam contacts the slider and the nose of the cam passes through the peak of the bearing surface, a direction to which an elastic force of the compressive coil spring is applied is changed, and the center axis of the cam center is arranged such that the center axis extends perpendicular to a center line of the slider and is located thereon, and the nose is arranged such that when one side of the outer cam surface relative to the nose contacts the front portion relative to the peak of the bearing surface, the compressive coil spring urges the pivotal lever in an opening direction, and when the nose of the cam surface contacts the rear portion relative to the peak of the bearing surface, the compressive coil spring urges the pivotal lever in a closing direction opposite to the opening direction.

2. A hinge device according to claim 1, wherein the cam is formed around the hinge connector and is integrally foamed together.

3. A hinge device according to claim 2, wherein the housing has a pair of hinge holes formed at the upper portion thereof, and the hinge connector has a hinge hole rotationally coupled to the upper portion of the housing, the hinge device further comprising a hinge shaft inserted into and coupled to the hinge holes of the housing and the hinge hole of the pivotal lever to rotationally support the pivotal lever and the cover.

4. A hinge device according to claim 1, wherein the compressive coil spring has a longitudinal axis coincide with the center of the slider.

5. A hinge device according to claim 1, wherein the peak and the nose are arranged such that the peak is deviated from the center line of the slider.

* * * * *